US007575061B2

(12) United States Patent
Angman et al.

(10) Patent No.: US 7,575,061 B2
(45) Date of Patent: Aug. 18, 2009

(54) WIRELINE ENTRY SUB AND METHOD OF USING

(75) Inventors: Per G. Angman, Calgary (CA); Tommy M. Warren, Coweta, OK (US)

(73) Assignee: Tesco Corporation, Calgary, Alberta (CA)

( * ) Notice: Subject to any disclaimer, the term of this patent is extended or adjusted under 35 U.S.C. 154(b) by 99 days.

(21) Appl. No.: 11/458,294

(22) Filed: Jul. 18, 2006

(65) Prior Publication Data

US 2007/0056722 A1 Mar. 15, 2007

Related U.S. Application Data

(60) Provisional application No. 60/595,607, filed on Jul. 19, 2005, provisional application No. 60/595,910, filed on Aug. 16, 2005.

(51) Int. Cl.
*E21B 19/00* (2006.01)

(52) U.S. Cl. ..... 166/385; 166/241.5; 166/77.1

(58) Field of Classification Search ..... 166/77.1, 166/77.52, 241.5, 242.5, 385
See application file for complete search history.

(56) References Cited

U.S. PATENT DOCUMENTS 2,370,818 A * 3/1945 Silverman ..... 324/356
2,567,009 A 9/1951 Calhoun et al.
2,569,390 A * 9/1951 Sewell ..... 175/50
3,638,988 A 2/1972 Brown
3,920,076 A 11/1975 Laky
4,093,294 A * 6/1978 Taylor ..... 294/86.25
4,405,263 A * 9/1983 Hall ..... 405/224
4,428,421 A * 1/1984 Rankin ..... 166/84.3
4,577,687 A * 3/1986 Lanmon, II ..... 166/243
4,681,162 A * 7/1987 Boyd ..... 166/242.5
4,899,816 A 2/1990 Mine
5,435,395 A * 7/1995 Connell ..... 166/384
5,735,351 A 4/1998 Helms
5,803,191 A * 9/1998 Mackintosh ..... 175/170
5,960,881 A 10/1999 Allamon et al.
5,967,477 A * 10/1999 Walmsley ..... 248/230.2
6,202,764 B1 * 3/2001 Ables et al. ..... 175/162

(Continued)

FOREIGN PATENT DOCUMENTS

CA 1174165 9/1984

(Continued)

OTHER PUBLICATIONS

Tommy Warren et al, "Casing Drilling Technology Moves to More Challenging Applications" AADE 01-NC-HO-32, AADE National Drilling Technical Conference, Houston, Texas, Mar. 27-29, 2001.

*Primary Examiner*—Jennifer H Gay
*Assistant Examiner*—Cathleen R Hutchins
(74) *Attorney, Agent, or Firm*—Bracewell & Giuliani LLP

(57) ABSTRACT

A wireline entry sub includes a body having an upper end, a lower end and a longitudinal, center axis therebetween, the body adapted for connection below a top drive to a wellbore string of tubulars; a slot on the body open a depth from a body outer surface to at least the longitudinal center axis; a wireline entry port extending through the body from the slot to open adjacent the lower end; and means for facilitating rig up of the wireline entry sub.

8 Claims, 5 Drawing Sheets

U.S. PATENT DOCUMENTS

| | | | | |
|---|---|---|---|---|
| 6,244,345 | B1 | 6/2001 | Helms | |
| 6,354,380 | B1 | 3/2002 | Becnel et al. | |
| 6,367,553 | B1 | 4/2002 | Boyd | |
| 6,655,453 | B2 | 12/2003 | Head | |
| 6,913,084 | B2 | 7/2005 | Boyd | |
| 7,100,699 | B2 * | 9/2006 | Helms et al. | 166/381 |
| 7,131,497 | B2 * | 11/2006 | Helms et al. | 166/381 |
| 7,341,101 | B1 * | 3/2008 | Moretz | 166/77.1 |
| 2006/0032638 | A1 * | 2/2006 | Giroux et al. | 166/377 |
| 2007/0158078 | A1 * | 7/2007 | Boyd | 166/380 |
| 2007/0199718 | A1 * | 8/2007 | Boyd | 166/379 |
| 2008/0059073 | A1 | 3/2008 | Giroux et al. | |

FOREIGN PATENT DOCUMENTS

| | | |
|---|---|---|
| CA | 1225021 | 8/1987 |
| CA | 2022144 | 2/1991 |
| CA | 2145130 | 9/1995 |
| CA | 2214798 | 9/1996 |
| CA | 2512800 | 9/2001 |
| CA | 2448841 | 5/2005 |
| CA | 2514136 | 1/2006 |
| GB | 2223253 | 4/1990 |

* cited by examiner

WIRELINE ENTRY SUB AND METHOD OF USING

FIELD OF THE INVENTION

The invention relates to an oil field tool for handling wireline and, in particular, a wireline entry sub.

BACKGROUND

Conventional oil field casing may be used as the drillstring for drilling oil and gas wells to simultaneously drill and case the wellbore. Once the wellbore is drilled to the desired depth, the casing is cemented into the earth without withdrawing it from the wellbore. A retrievable drilling assembly, including a bit and borehole enlarging tool, may be attached to the bottom end of the casing for drilling. This drilling assembly often includes other components such as mud motors, MWD collars, LWD collars, non-magnetic drill collars, steel drill collars, and stabilizers.

Once the casing is drilled to the desired casing setting depth, the drilling BHA is retrieved from the casing with a wireline before the casing is cemented in place. In some cases the BHA must be retrieved and replaced before the casing is drilled to its terminal depth, for example to replace a worn drill bit or to replace some other failed component in the BHA. A provision must be made for the wireline to be run through the casing to retrieve the BHA. It is often advantageous to circulate drilling fluid down the ID of the casing while the wireline is being run and the BHA recovered to assure that any influx of formation fluids is circulated out of the well in a controlled manner. It is also advantageous to reciprocate the casing while the BHA is being recovered so that the casing does not become stuck in the borehole. A swivel or a power drive assembly and a casing drive system may be attached to the casing in order for circulation and reciprocation of the casing to be accomplished. A power drive assembly such as a top drive is often used to rotate the casing for drilling. The casing may be attached to the top drive with a tubular gripping device such as a casing drive system that grips the top of the casing without screwing into its upper threaded connection. The casing drive system also includes seals to contain the drilling fluid so that it can be circulated down the inside diameter of the casing to flush cuttings away from the drill bit and up the annulus between the casing and the borehole wall.

The drilling rig used to drill with casing may be a specially designed rig that facilitates the efficient operation of the wireline for running and retrieving the drilling BHA. The rig also must be equipped with a wireline unit that is capable of handling the drilling BHAs. For rigs designed for casing drilling, this wireline unit may be provided as an integral part of the rig.

Access for the wireline is provided through the top of the swivel, which may be incorporated as an integral part of the top drive. The wireline access through the top of the swivel may be facilitated by utilizing a split crown block and split traveling block. Split blocks are ones where the sheaves used for carrying the drilling line are divided into two groups spaced laterally apart. The split crown arrangement allows a wireline sheave to be hung at the crown of the rig so the wireline can be aligned with the central axis of the drillstring. The split traveling block provides room for a wireline stripper assembly and wireline BOP to be attached to the top of the swivel to prevent the pressurized drilling fluid from escaping around the wireline as it is being run into and pulled from the casing. In some situations, it may be sufficient to provide only a split traveling block as the fleet angle from having the crown sheave offset slightly from the central axis of the drillstring.

The drilling BHA may be quite heavy and weigh as much as 30,000 pounds. A large braided cable, for example ¾" in diameter, may be required to support this much weight and the sheaves used with such a cable are relatively large in diameter, for example 30" in diameter. It is important that the sheaves and wireline pressure control equipment be positioned so that the wireline can enter the casing along its central axis. Otherwise, the cable will exert lateral forces on the casing or other equipment and will quickly cut into the equipment as it is run into and out of the well.

In some situations, it may be advantageous to use a drilling rig that is designed specifically for drilling with casing when one is available. Often such a rig may not be available or only a portion of the well may be drilled with casing so that it may be more convenient to use a conventional rig.

There are only a few drilling rigs in the current fleet of rigs available for use in drilling oil and gas well that are equipped as described above for using casing as the drillstring. While it is possible to modify any drilling rig to include the facilities needed to handle the wireline when drilling with casing, most conventional drilling rigs do not include split crown blocks and split traveling blocks to facilitate wireline access along the central axis of the drillstring. The time required to modify the rig to accommodate these parts and the capital cost of the modifications may not be justified when the rig is used to drill only a portion of a well with casing. Furthermore, the owner of the rig may not allow structural changes to be made to the rig. This is particularly true for expensive offshore rigs.

There are devices described in the prior art for providing wireline access to the ID of a drillstring. For example, U.S. Pat. No. 6,202,764 describes a wireline entry sub that can facilitate wireline use on a rig. Although such a wireline entry sub has been described, it is desirable that an improved sub be provided.

For example, in some cases, particularly for offshore rigs, the time and effort required for converting a rig so that it becomes capable of handling a wireline may be a problematic issue.

SUMMARY

In accordance with a broad aspect of the present invention, there is provided a wireline entry sub, comprising: a body including an upper end, a lower end and a longitudinal, center axis therebetween; a wireline passage extending through the body from an entry port to open adjacent the lower end; and a tubular supporting mechanism on the lower end, the tubular supporting mechanism capable of connecting to a tubular segment without a threaded connection between the body and the tubular segment.

In accordance with another broad aspect of the present invention, there is provided a method for installing a wireline entry sub onto a tubular segment, the wireline entry sub including a body having an upper end, a lower end and a longitudinal, center axis therebetween and a wireline passage extending through the body from an entry port to open adjacent the lower end and the tubular segment being accessible as a stump secured by a drilling rig and the stump including an open upper end, the method comprising the steps of: providing a tubular supporting mechanism coupled to the lower end of the wireline entry sub; and connecting the tubular supporting mechanism to the stump without completing a threaded connection therebetween.

In accordance with another broad aspect of the present invention, there is provided a well process system for handling wireline comprising: a wireline entry sub having a body including an upper end, a lower end and a longitudinal, center axis therebetween, an opening on the body open a depth from a body outer surface to at least the longitudinal center axis and a wireline passage extending through the body from the opening to the lower end; a vertically movable power drive assembly including a longitudinally extending output shaft movable vertically with the power drive assembly; and an upper tubular gripping device coupled to the output shaft, the upper tubular gripping device having an end to grip and support the upper end of the wireline entry sub.

In accordance with another broad aspect of the present invention, there is provided a method for adding a wireline entry sub to a well process system for handling a wireline in a well bore operation, the wireline entry sub having a body including an upper, tubular end, a lower end and a longitudinal, center axis therebetween, a wireline passage extending through the body from a wireline entry port to a port adjacent the lower end and the well bore operation including a stump of the tubular string positioned in a well bore secured by a drilling rig and the stump comprising an open upper end, the method comprising the steps of: providing in a drilling rig a vertically moveable power drive assembly which includes a longitudinally extending output shaft moveable with the power drive assembly; providing a tubular gripping device coupled to the output shaft of the power drive assembly, the tubular gripping device having a gripping mechanism selected to grip and support a tubular member; and engaging the upper tubular end of the wireline entry sub with the gripping mechanism of the tubular gripping device so that the wireline entry sub is moveable with and positioned below the power drive assembly.

In accordance with another broad aspect of the present invention, there is provided a wireline entry sub comprising: a body including an upper end, a lower end and a longitudinal, center axis therebetween; a spear on the lower end; a circumferential seal extending about the spear; and a wireline passage extending through the body from a wireline entry port to a port opening on a lower end of the spear.

In accordance with another broad aspect of the present invention, there is provided a wireline entry sub comprising: a body including an upper end, a lower end and a longitudinal, center axis therebetween; a wireline passage extending through the body from a wireline entry port to a port opening adjacent the lower end; and a tool connector adjacent the lower end positioned adjacent the port to releasably engage an end of a wireline tool.

In accordance with another broad aspect of the present invention, there is provided a method for handling a wireline tool for tripping through a well, comprising: installing a wireline entry sub in a rig, the wireline entry sub including a tool connector on its lower end; inserting a wireline through the wireline entry sub; connecting a wireline tool to wireline; supporting the wireline tool with the tool connector; releasing the wireline tool from engagement with the tool connector; and lowering the wireline tool into the well with the wireline.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Although many different embodiments of the invention are possible, with reference to the figures as appropriate. It is understood that while the invention is described below being employed with wireline (whether "slick line", braided cable, electric line, etc.), the invention is not limited to use with wireline, rather other small diameter conduits such as coiled tubing may be used with it as well.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
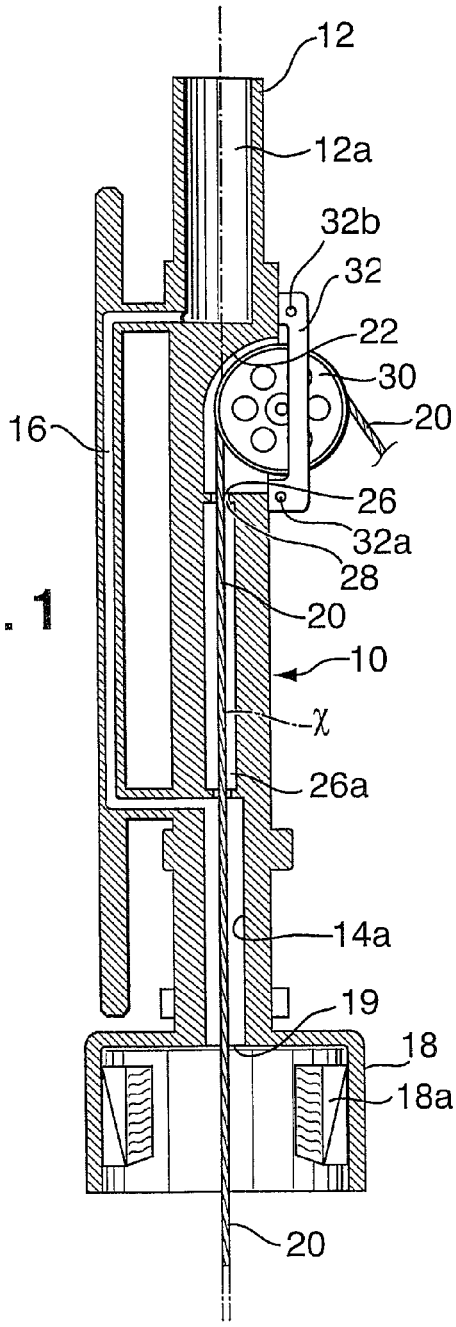
FIG. 1 is a schematic sectional view along the center axis of one embodiment of a wireline entry sub according to one aspect of the present invention.

FIG. 1 shows a wireline entry sub 10 according to one aspect of the present invention. Entry sub 10 is connectable between a top drive and a well bore tubular during use to permit the use of a wireline during a well bore operation.

Wireline entry sub 10 includes a body including an upper collar 12, a lower end 14 and a longitudinal, center axis x therebetween. In the illustrated embodiment, upper collar 12 has a bore 12*a* therethrough and lower end 14 has a bore 14*a* therethrough. A fluid passage 16 extends to fluidly connect upper collar bore 12*a* and lower end bore 14*a*. A flow-through fluid path therefore exists along the length of entry sub 10, which permits fluid circulation through the entry sub, between the top drive and the well bore tubular, during use. While fluid passage 16 is shown extending through a line spaced from the body of the sub, it is to be understood that a fluid passage may be bored or otherwise formed through the body if that is desired.

Entry sub 10 is formed to accept a wireline 20 passing from a source such as storage reel (for example item 50 in FIG. 2) through entry sub 10 to, thereafter, pass downhole. Entry sub 10 has an opening formed as a slot 22 extending from the sub body outer surface into the sub body material between upper collar 12 and lower end 14. Slot 22 extends a depth into the sub at least ½ the sub's effective outer diameter so that slot 22 is open to the sub center axis x. A wireline entry port 26 is formed in slot 22, for example at its base, and connects to a passage 26*a* that extends through the entry sub body toward lower end. Wireline passage 26*a* in some embodiments may join up with the sub's fluid passage or with the bore through lower end. In the illustrated embodiment, fluid passage 16 connects with passage 26*a* and together these passages open into bore 14*a*.

A seal assembly 28 may be mounted in port 26 for sealing about a wireline that may be installed to pass therethrough. An aperture through seal assembly 28 may be substantially concentric with the center axis x of sub 10.

A sheave 30 may be connected to entry sub 10 in association with slot 22. Sheave 30 directs wireline into position for passing through port 26 and any seal assembly 28 therein. Wireline 20 passes over sheave 30, through seal assembly 28, through passage 26*a* and out through lower end 14 before passing downhole. Sheave 30 is positioned and/or configured such that wireline 20 roved over it comes off adjacent port 26 substantially aligned with the center axis x of lower end 14. In the one embodiment, sheave 30 may be connected to entry sub 10 via a bracket 32. Bracket 32 may include pivotal connections 32*a* and releasable connections 32*b* to permit the sheave mounted thereon to be pivoted out of slot 22 away from port 26 to facilitate installation of a wireline about the sheave and through port 26.

Sheave 30 may take various forms and, for example, may include one or more idler sheaves and/or one or more traction generating members such as driven sheaves for generating a pull force on the wireline. If desired, any such driven sheaves may be driven by connection, through gears, drive shaft, hydraulic connections, etc. from the top drive. In another embodiment, entry sub 10 may include a wireline pulling device other than sheave 30 for applying a pulling force to the wireline.

Upper collar 12 may include an inside or an outside surface formed to be gripped by a tubular gripping device. Tubular gripping devices can vary significantly in form and function. Tubular gripping devices operate without reliance on threaded connections and may often include an internal and/or external tubular gripping mechanism. Unlike connections effected by threaded connections, tubular gripping devices can operate without requiring significant relative rotational movement, between the gripping device and the item to be gripped. Gripping devices may include packer-type systems that expand to grip an inner or an outer diameter of the tubular to be gripped. Tubular gripping mechanisms may alternately or in addition include teethed dies that can be driven to grip and bite into the tubular. These gripping mechanisms may be driven mechanically, hydraulically, by motors, etc. Generally, gripping mechanisms driven by hydraulics can be operated quickly and without requiring significant movement of the tool on which the mechanism is mounted. Some gripping devices for casing-type tubulars, for example, are described in U.S. Pat. No. 6,311,792, issued November 2001 and International application WO00/05483, published February 2000, both to TESCO Corporation.

With consideration to the foregoing, the form of upper collar 12 can also vary significantly depending on the form of tubular gripping device to be used in order to be effectively gripped thereby. In one embodiment, upper collar 12 can conveniently be formed to resemble the necessary structural features of a tubular normally intended to be gripped by the tubular gripping device that permit entry sub 10 to be gripped by the tubular gripping mechanism. For example, the inner or the outer surface of upper collar 12 be sized, configured and/or include material suitable for gripping by the tubular gripping device to be used.

In some embodiments, pipe elevators may be provided for use with tubular gripping devices. Elevators operate to catch on a shoulder formed on an outer surface of the tubular to be gripped. Thus, upper collar 12 may be formed to include an upset to permit handling by a pipe elevator, if desired.

Alternately or in addition, lower end 14 may have secured thereto, or formed integral therewith, a tubular support device 18 including a tubular support mechanism for securing the entry sub and a tubular segment (for example shown as segment 46 in FIG. 2) together, so that the entry sub can support the weight of the tubular segment and hold the tubular segment so that wireline from the entry sub may pass therein. The tubular segment may be independent or connected to other tubulars in a tubular string. Tubular support device 18 may operate, for example, by catching on a portion of, engaging or gripping the tubular segment. To be particularly useful, tubular support device may be capable of connecting to the tubular segment without threaded connection therebetween. Such a non-threaded tubular connection may include for example a tubular gripping mechanism or a catch-type mechanism, employing elevator-type support.

In the illustrated embodiment, tubular support device 18 is a tubular gripping device. Tubular gripping devices may vary, as was described in detail hereinabove. The present device for example is configured to externally grip a tubular using teethed slips 18*a*. In the illustrated embodiment, device 18 is connected at the lower end of the entry sub and includes a port 19 therein, which may extend along axis x, through which a wireline can pass out through the bottom end of the device. Port 19 communicates with bore 14*a*, which in turn is in communication with fluid passage 16 such that fluid from the entry sub can pass through port 19 and out into any tubular gripped by device 18.

Figure 2:
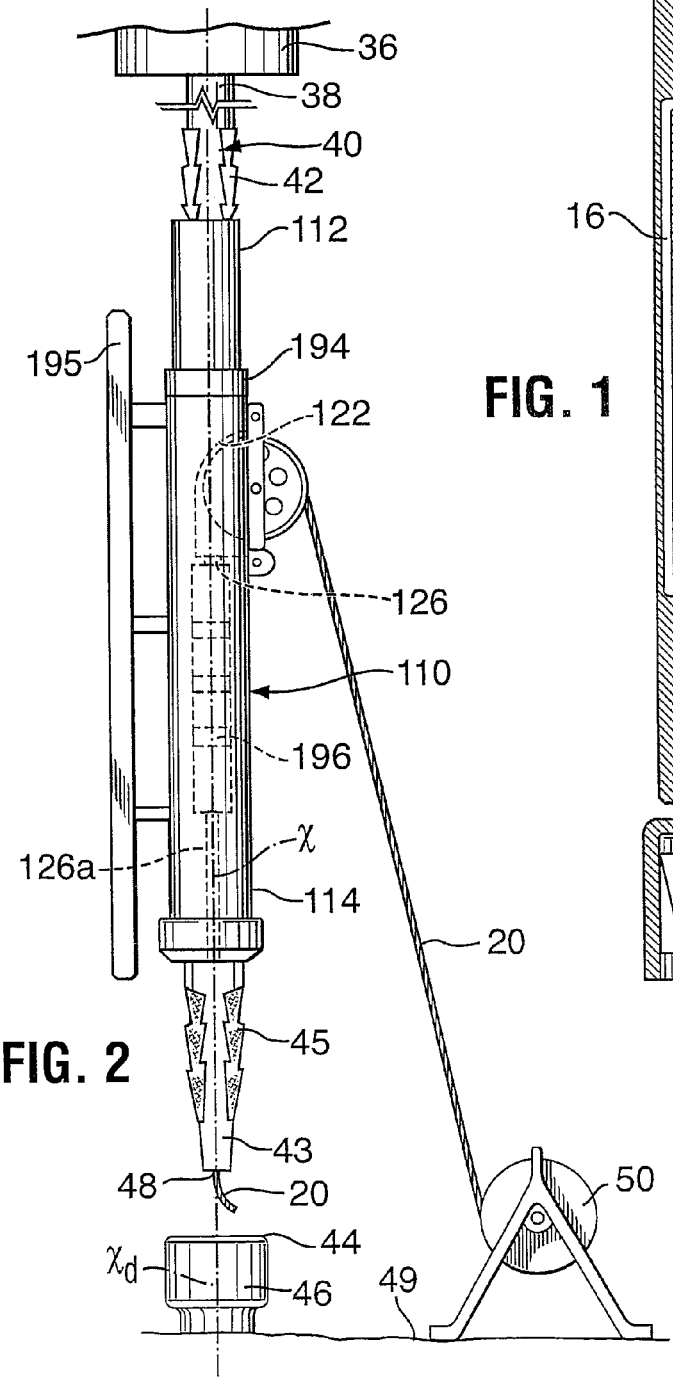
FIG. 2 is a side elevation view of a well process assembly according to the present invention in an operational setting with some internal components shown in phantom.

FIG. 2 shows one of many possible embodiments of a well process system for manipulating tubulars in a well bore. The well process system includes a wireline entry sub 110 having a body including an upper end 112, a lower end 114 and a longitudinal, center axis x therebetween, an opening 122 provides access to the longitudinal center axis x of the body and a wireline entry port 126 positioned coincident with the center axis x. Port 126 opens into a passage 126*a* extending through the body from the opening adjacent the lower end 114 in a position substantially along axis x. The well process system further includes a vertically movable power drive assembly 36, such as a top drive, including a longitudinally extending output shaft 38 movable vertically with the power drive assembly and an upper tubular gripping device 40 coupled to output shaft 38. Upper tubular gripping device 40 includes a spear carrying a hydraulically driven gripping mechanism, indicated generally at 42, including toothed dies drivable to grip and support upper end 112 of the wireline entry sub. To be gripped by upper tubular gripping device 40, upper end 112 can be formed to resemble a tubular that device is normally intended to grip. For example, upper end 112 may have a tubular form with an inner diameter sized to accept an end of the gripping device with mechanism 42 mounted thereon and may include an inner wall formed to be gripped by the dies of mechanism 42. Upper tubular gripping device 40 may also include a fluid passage therethrough to convey fluid to entry sub 110 and thereafter downhole. In such an embodiment, a seal may be provided in an interface between device 40 and sub 110, for example, carried on device 40.

In the illustrated embodiment, a lower tubular gripping device 43 is shown coupled to lower end 114 of the wireline entry sub. The lower tubular gripping device includes a tubular gripping mechanism 45 selected to grip and support a top end 44 of a tubular segment 46. Lower tubular gripping device 43 also includes a port 48 opening adjacent its bottom end. Port 48 provides access to a bore 48*a* through device, which is aligned with and communicates to passage 126*a*. As such, during operation a wireline can pass from passage 126*a* through device 43 and into the top end of the tubular segment.

The well process system including sub 110 may be used in a drilling rig (only the floor 49 of which is shown) to allow a wireline 20 to be run in hole. Wireline 20 enters sub 110 through wireline entry port 126, extends through port 126 down through the sub and lower tubular gripping device 43 to exit through port 48 after which it can pass into tubular segment 46, which may be the upper most segment of a tubular string such as a drill string or a casing string. The well process system permits a well to be converted for use with a wireline very quickly and without extensive modifications to a drilling rig. In particular, conversion of a rig to handle wireline requires only that the top drive and upper tubular gripping device 40 release the upper most tubular segment, for example, leaving it supported in the drill floor 49, for example in a rotary table or in a spider and slips. Then sub 110 is engaged by upper tubular gripping device 40, which may be as easy as hydraulically driving gripping dies to engage an outer diameter or an inner diameter of upper end 112 so that the wireline entry sub is moveable with and positioned below the top drive assembly. Either before or after sub 110 is installed on upper tubular gripping device 40, wireline storage reel 50 is brought onto or adjacent the rig and wireline 20 is inserted into sub 110. Once wireline 20 extends through port 48 (or out through the bottom end of the entry sub, when no lower device 43 is used), wireline tools may then be connected to wireline 20 and lowered into tubular 46 supported by the drilling rig.

In the embodiment of FIG. 2, if no lower device 43 is used, wireline entry sub 110 may be connected by threaded engagement to tubular 46. In such case, the wireline entry sub may be threaded to the stump of tubular 46 generally after the wireline tools are connected to the wireline and either before or after the sub's upper end is brought into engagement with upper tubular gripping device 40. A swivel connection may be of use in such an embodiment to facilitate connection between the parts.

If wireline entry sub 110, as shown, includes a lower tubular gripping device 43, then tubular segment 46 may be gripped by device 43 before or after securing sub 110 under the top drive. For example, sub 110 may be secured onto tubular by raising the top drive in the drilling rig and vertically positioning the top drive until sub 110 is substantially vertically aligned with the stump of the tubular segment; lowering the top drive until lower tubular gripping device 43 is positioned adjacent, over or, in the present embodiment, in the upper end of the tubular segment and then driving the gripping mechanism of device 43 to engage tubular 46. This can be done without a threaded connection, which facilitates and speed connection between the parts.

The sub may be installed so that it's center axis x is not angled or displaced from the center axis xd of tubular segment 46, but instead is substantially coincident therewith so that wireline 20 may pass into drill string in along a substantially straight line coincident the center axis xd of tubular 46 and any string attached therebelow.

When entry sub 110 is secured on the upper end of a tubular segment, or supports and grips a tubular segment, the tubular segment and the entirety of any tubular string connected thereto may be lifted by raising the top drive unit and sub 110 with the rig drawworks. Accordingly, entry sub 110 is made of materials and has dimensions sufficient to give entry sub 110 sufficient tensile strength to lift a drill string. By way of example only, entry sub 110 may be made of high strength carbon steel, stainless steel, or other similar materials. The "straight-line" aspect of the tool, that is, the center or lift axis of entry sub 110 being substantially coincident with the center axis of a drill string, results in no undesirable bending moment or canting when a drill string is lifted with entry sub 10 in place.

If desired, a swivel bearing 194 may be incorporated above or below upper end 112 to prevent rotation from being conveyed from the top drive to the sub.

A positive flow control valve (commonly known in the industry as a "TIW" valve) may be placed below entry sub 110, to permit pressure isolation of the drill string while entry sub 110 along with wireline and wireline tools are rigged up.

If desired to facilitate handling, a wireline entry sub may include a transportation skid 195.

In certain operational situations where wireline operations are conducted under high pressure a wireline blow out preventer assembly (BOP) 196 may be employed in lower end 114 or may be positioned in a sub below sub 110, in addition to or alternately from any seal assembly in port 126. In the illustrated embodiment, assembly 196 is positioned in passage 126*a* immediately below port 126. Assembly 196 may include, for example, ream elements to seal around the wire, to seal the cavity a wireline is not present and to cut the wire and seal the cavity, if necessary. The wireline BOP may be remotely controlled by an operator for the rig.

Figure 3:
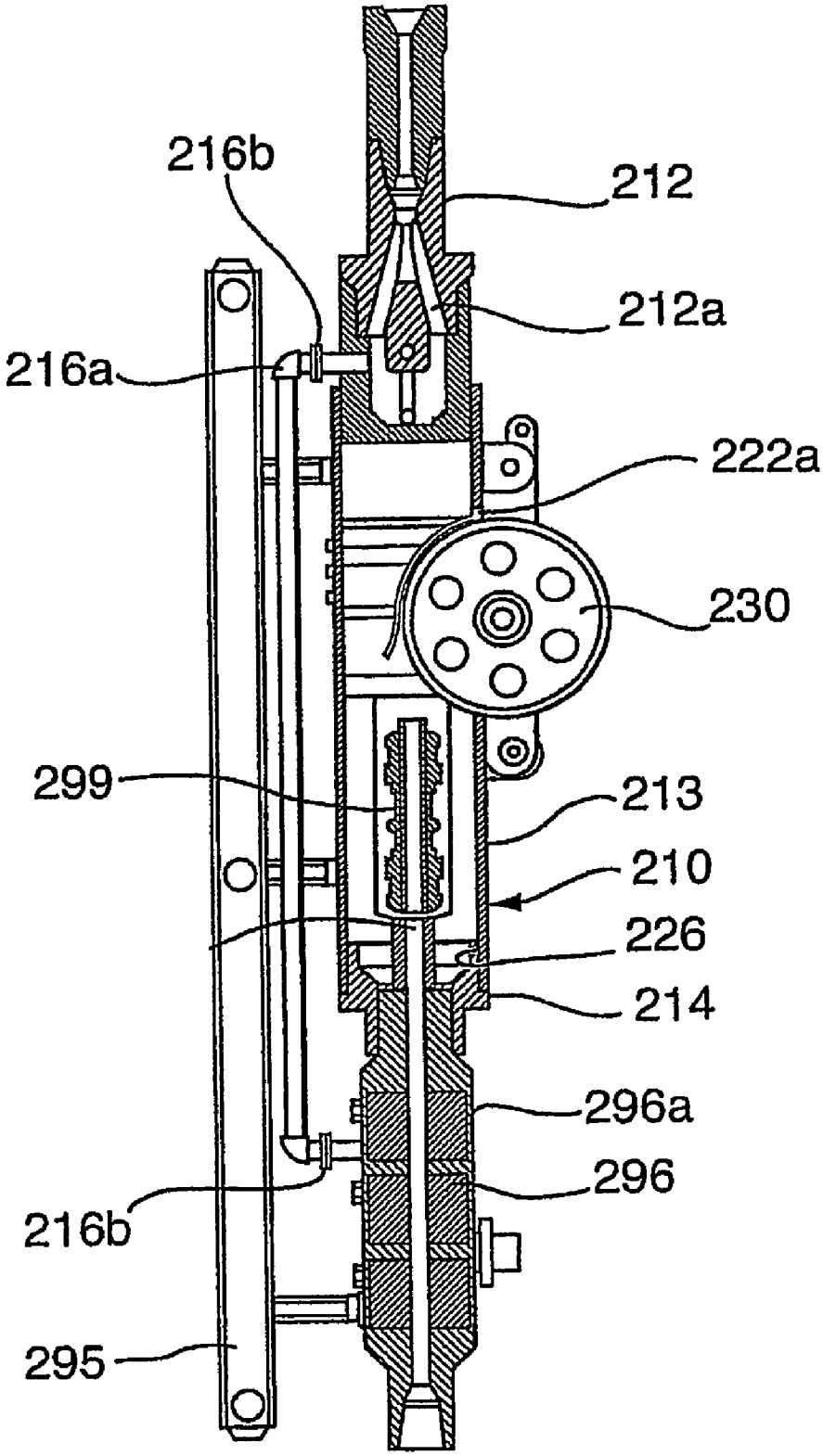
FIG. 3 is a sectional view along the center axis of another wireline entry sub according to the present invention.

FIG. 3 shows another wireline entry sub 210 according to one aspect of the present invention. Entry sub 210 is connectable between a top drive and a well bore tubular during use to permit the use of a wireline during a well bore operation. While the entry sub of FIG. 3 has many components similar to those described above, it does show some optional features not previously described. In this illustrated embodiment for example, wireline entry sub 210 includes a body formed of a plurality of connected parts. The body includes an upper end 212 and a hollow intermediate body 213 defining a lower end 214. A longitudinal, center axis may be defined extending between the upper end and the lower end.

In this illustrated embodiment, a fluid passage extends from a bore 212*a* in upper end 212 through an external line 216*a* that extends past lower end 214 to a blow out preventer 296 connected thereto. As such, line 216*a* acts to bypass lower end 214 of the entry sub such that its construction can be simplified. Line 216*a* is connected by couplings 216*b* such that the line can be easily disconnected, should that be required.

Entry sub 210 and blow out preventer 296 are mounted to a skid 295, which facilitates handling and strengthens the overall assembly. In this embodiment, the BOP housing 296*a* forms part of a structure to support the weight load of any tubulars connected therebelow. This differs from the embodiment of FIG. 2, wherein the BOP does not support any of the weight load of tubular segment 46 and any string attached thereto.

Entry sub 210 is formed to accept a wireline (not shown) passing from a source through entry sub 210 to, thereafter, pass through the blow out preventer and then downhole. In the illustrated embodiment, the entry sub hollow body portion includes slot 222*a* therethrough that provides access to the hollow interior of body portion 213 which together accommodate a portion of a sheave 230 therein. A wireline entry port is defined as an opening 226 at lower end 214. An end of the lower end of body portion 213 is open and is sized to accept an upper ported end 296*a* of the blow out preventer housing into which the wireline can be inserted. A pack off 299 can be positioned in body portion 213 of the entry sub and connected, as by use of an hydraulic quick connect, to BOP 296 to provide a seal about the wireline above the blow out preventer.

Figure 4:
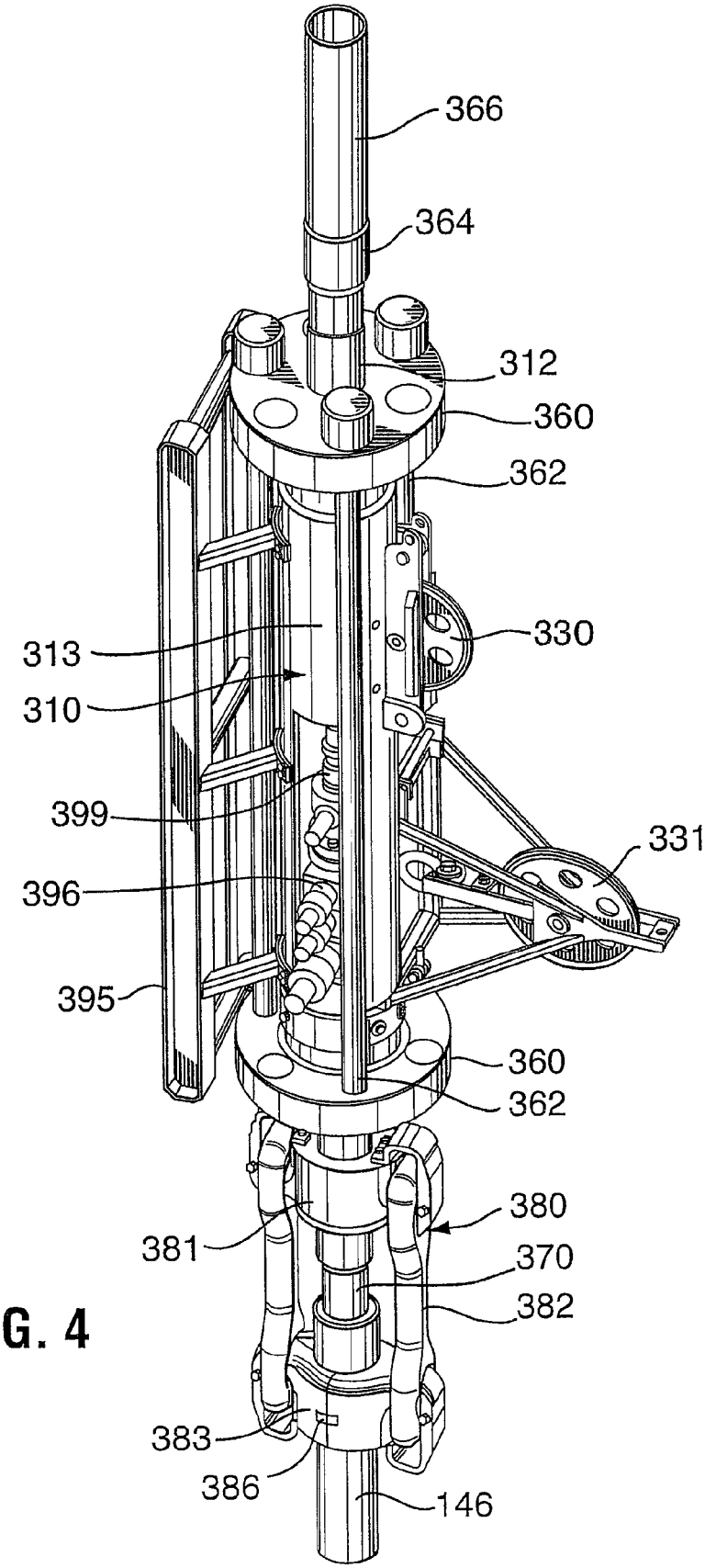
FIG. 4 is a perspective view from above of a portion of a well process assembly according to the present invention.
Figure 5:
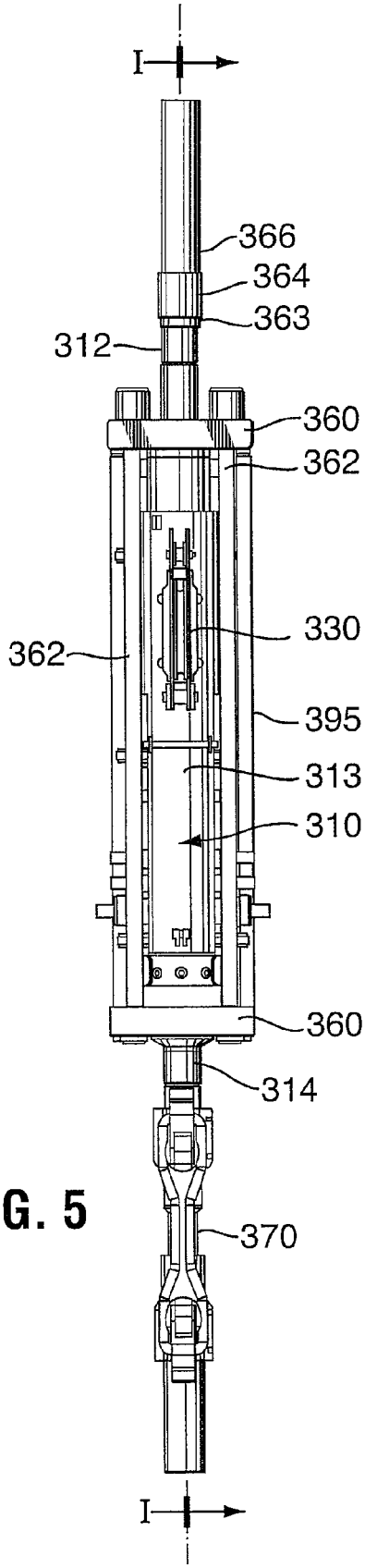
FIG. 5 is a front elevation of the assembly of FIG. 4.
Figure 6:
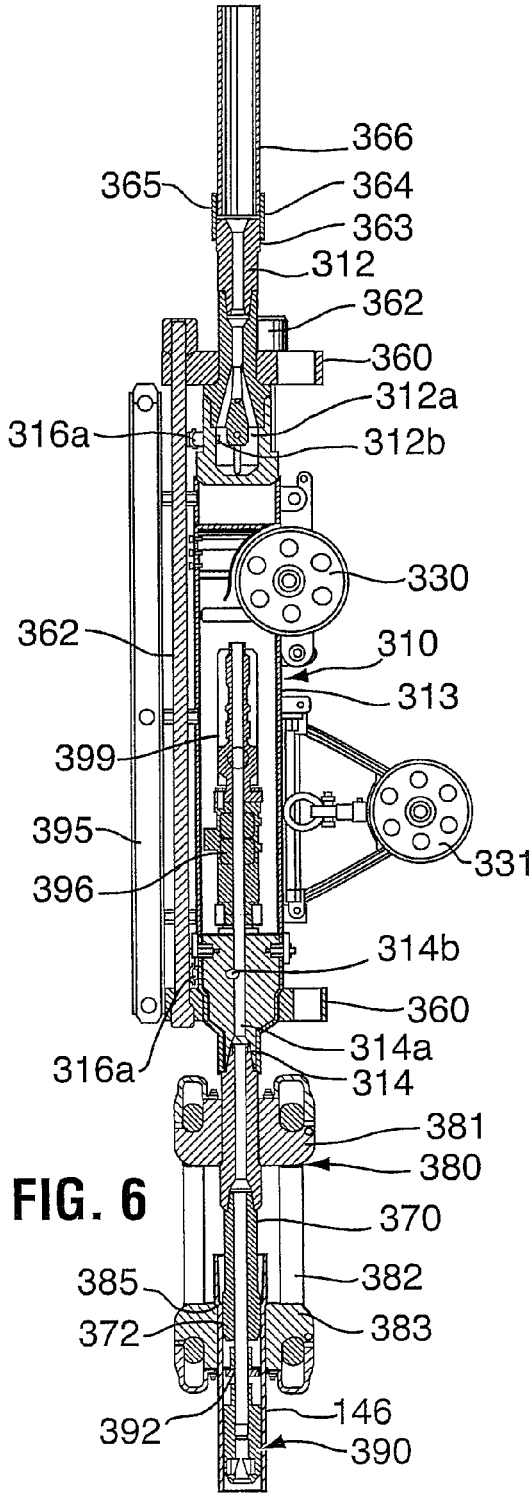
FIG. 6 is a sectional view along line I-I of FIG. 4.

With reference to FIGS. 4 to 6, another wireline entry sub 310 is shown as a portion of a well process system. Again, the embodiment of FIGS. 4 to 6 show additional possible aspects of the invention.

In this illustrated embodiment for example, entry sub 310 is connectable between a top drive (not shown) and a well bore tubular during use to permit the use of a wireline (not shown) during a well bore operation. Wireline entry sub 310 includes a body formed of a plurality of connected parts that together define an upper end 312, a hollow intermediate body 313, a lower end 314 and an outer support assembly 315. A longitudinal, center axis may be defined extending between the upper end and the lower end.

Outer support assembly 315 includes mounting flanges 360 secured adjacent the upper and the lower ends of the sub and structural support rods 362 mounted therebetween. Outer support assembly 315 is selected to provide lateral strength to the sub and to transfer load between the ends. This strength and load transfer is provided while permitting access to the internal components. A skid 395 may be mounted to sub 310 to facilitate handling and further strengthen the overall assembly.

In this illustrated embodiment, a fluid passage extends from a bore 312*a* and lateral port 312*b* in upper end 312 through an external line 316*a* to a lateral port 314*b* and bore 314*a* in the lower end. A pack off 399 and a blow out preventer 396 are installed in intermediate body portion 313 and together with bore 314*a* form a wireline passage through which a wireline may pass.

A first sheave 330 is mounted to direct a wireline roved thereabout between a source (not shown) and pack off 399. A second sheave 331 is installable on the sub to further direct the wireline if desired.

The wireline passage formed through pack off 399, blow out preventer 396 and bore 314*a* extends along the sub's center axis and sheave 330 is positioned on sub to release wireline above and inline with the wireline passage so that any wireline passing therethrough extends in a straight line from the sheave out the bottom of the sub.

In this illustrated embodiment, upper end 312 is formed as a pup joint including a shoulder 363 formed by a casing-type coupling 364 and a length of a casing-type tubular 366, which together may be selected to resemble the form of tubulars normally handled by the top drive intended to be used with sub 310. Coupling 364 creates a shoulder resembling that of casing connection such that elevators can be used to pick up sub 310 and align it for gripping by a tubular gripping device on the top drive. The elevators may be carried by the top drive or by a casing handling system of a tubular gripping device installed on the top drive. Casing-type tubular 366 provides a length and an interior or exterior surface selected to be gripped by the tubular gripping device being used on the rig. Casing-type tubular 366 and coupling 364 may be formed removable from the sub, as shown by threaded connections 365, such that these components can be removed and replaced if they become damaged or to select their sizes such that casing-type tubular 366 and coupling 364 are suitable for engagement with the top drive, tubular gripping device and/or elevators with which the sub is to be used.

Also in this illustrated embodiment, lower end 314 is formed as a spear 370. With consideration as to the size of tubulars 146 to be handled, spear 370 may be selected to fit within the tubular inner diameter. A seal, such as may be provided by packer cups 372, may be carried on the spear to create a seal between the tubular inner diameter and the body of the spear such that fluid is prevented from passing upwardly therebetween out of tubular 146. A well control ring (not shown) can also be carried on the spear, if desired. The well control ring may be formed to connected into an annulus between the spear and the upper end of the tubular in which the spear is inserted.

In the embodiment of FIGS. 4 to 6, a catch-type tubular supporting device is provided by pipe elevators 380. Pipe elevators 380 in this embodiment include an upper elevator 381, links 382 and lower elevator 383. Upper elevator 381 is securable to spear 370, as by provision of an upset shoulder 384 on the spear. As with standard pipe elevators, lower elevator 383 may be selected to act against a shoulder 385 formed on the outer surface of the tubulars being handled, such as that formed between the outer surface of a joint of casing 146*a* and the end 146*b* of a casing coupling. Lower elevator 383 may be selected to be a slip-type elevator to reduce adverse load effects on the casing connection, if desired. Links 382 may be secured between the upper and lower elevators and may be sized to ensure that the spear may be positioned and held within the tubular being handled with seal 372 in a position to act against the tubular inner diameter. Wireline entry sub 310 supports tubular 146 by use of pipe elevators 380. In particular, any force to separate tubular 146 from spear 370 is reacted through and resisted by pipe elevators 380. To facilitate use of pipe elevators 380, at least lower elevator 383 may include a hinge and releasable lock 386 such that they are openable and securable about tubular 146.

Also in the illustrated embodiment of FIG. 6, the wireline entry sub includes a tool connector device 390 for engaging wireline tools at surface. With such an embodiment, wireline tools may be releasably secured to entry sub 310 so that the wireline tools may be handled together with the entry sub. For example, during tripping out tools, the tool connector device can operate as a tool catcher wherein the wireline tools may be engaged at surface and removed together with entry sub 310 as it is raised away from the tubular stump. During installation of wireline tools to the tubular string, the tools may be secured via the tool connector to the end of a wireline entry sub. During installation, the wireline entry sub can be installed in the rig, for example by being gripped at its upper end by a casing drive system. Then a wireline may be installed through the entry sub and a wireline tool string may be connected to the wireline and assembled while an upper end of the tool string is engaged by the tool connector device. Thereafter, the assembled tools may be inserted into the inner diameter of a tubular string supported in the rig and the entry sub may be connected to the stump of the tubular string. The wireline tools may be disconnected from the tool connector device, as by manipulating the tool connector device to releasing engagement with the wireline tools. The wireline tools may then be lowered into the well while being supported on the wireline.

The tool connector device may also act to facilitate tool handling. For example, at surface, either before insertion of the tool string into the tubing string or once the wireline tool string is pulled to the surface, the wireline entry sub is disconnected from the tubular string and spaced above the tubing string to provide access to the tool string for disassembly. The weight of the tool string may be several thousand pounds. If the weight of the tool string is supported by the wireline, a tilting moment may be created on the wireline entry sub and, since the lower end is not laterally supported by attachment to the tubular string, it would cause the end to move away from the wellbore centerline and inhibit assembly/disassembly of the tools. Supporting the weight of the tool string on a tool catcher may eliminate the tilting moment and keep the axial force aligned with the wellbore centerline to facilitate tool handling. Thus, the weight of the tool string is supported by the wireline for transportation through the tubular string, but by use of a tool catcher, the weight may be supported directly by the wireline entry sub structure for handling the tool string when the wireline entry sub is disengaged from the tubular string.

Tool connector device 390 may be installed on the end of a spear 370, as shown, or another device or portion of a device that has access to the interior bore of the tubular segment into which the wireline is being run. For example, with reference to FIG. 2 a tool connector may be installed on an end of tubular gripping device 43.

Figure 7:
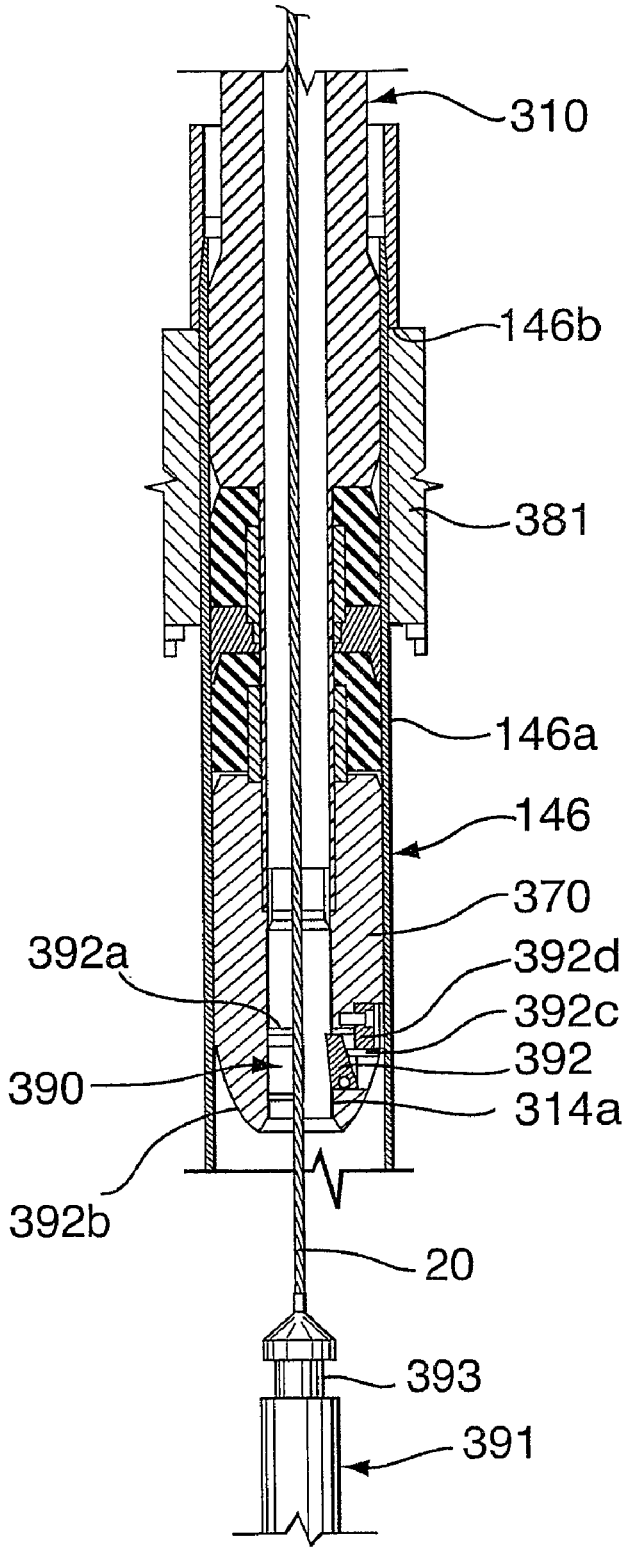
FIG. 7 is an enlarged portion of a tool connector useful on a wireline entry sub according to one aspect of the present invention.

An enlarged view of a mechanical tool connector device useful for a wireline entry sub is shown in FIG. 7. In this embodiment, tool connector device 390 is installed on a spear 370 of a wireline entry sub 310. Device 390 is selected to engage an enlarged member 391 of a tool or of a wireline connector. Device 390 and enlarged member 391 are formed to interlock as member 391 is pulled by wireline 20 into to the device. It will be appreciated that such an arrangement may include various engagement interacting mechanisms including for example, any of ratchet teeth, lock dogs, j-channel locks, detents, magnetic parts, etc. on one or both of the sub and the tool to be engaged. In the illustrated embodiment, device 390 includes one or more dogs 392 on spear 370 biased into bore 314*a*. Each dog 392 is formed to permit passage therepast upwardly of the tool end including a gland 393 but lock into the gland if it should attempt to pass downwardly over the dogs, which prevents the tool from passing downwardly out of engagement with the dogs. Each dog includes an upper end 392*a* creating a shoulder to engage in gland 393, a lower ramped side 392*b* formed to permit the tool to pass thereover and a biasing member 391*c*, such as a spring or a resilient member positioned to act between the spear body or an installation plug 392*d* and the dog. A dog 392 may be pushed against the biasing member to permit the tool to pass upwardly into bore 314*a* but will engage in gland 393 once the upper limit of the gland passes upper end 391*a* of the dog. Thus, a tool catcher may be used with a wireline entry sub to firmly engage a tool as it approaches surface. Of course other approaches may become apparent such as, for example, the biasing member may be replaced with a biasing arrangement, such as by installing the dogs to fall by their own weight to project out into the bore.

The tool connector can be configured to be releasable to release engagement with a wireline tool string either by manual disengagement or remotely, when desired. For example, the installation plugs may be removed to access the biasing members. In another embodiment, where the tool connector is used to launch a tool, the tool connector may be releasable remotely, for example when the wireline tools and the tool connector are already installed in the tubular segment. In such an embodiment, an electrical, hydraulic or mechanical release actuator may be employed such as for example, a solenoid, a fluid pressure actuated dog release system, a fluid pressure driven system for overcoming the biasing load on the biasing members, etc.

Although various aspects of the invention have been described herein, it is to be understood that not all aspects need be employed together. For example, a wireline entry sub according to the present invention may be used with any or all of a power drive assembly, an upper tubular gripping device, an upper end formed for engagement with a tubular gripping device, a tubular supporting device on its lower end, a spear, and/or a tool connector.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A method for installing a wireline entry sub between a string of conduit and a top drive of a drilling rig, the wireline entry sub including a frame assembly having an upper end, a lower end and a longitudinal, center axis therebetween, a wireline blowout preventer and wireline packoff mounted to the lower end and extending upward inside the frame assembly toward the upper end, a wireline passage extending through the frame assembly and through the blowout preventer and packoff to open adjacent the lower end, and a sheave mounted to the frame assembly, the method comprising the steps of:

extending a wireline over the sheave and through the wireline passage;

connecting a wire line tool to a lower end of the wireline and inserting the tool into the string of conduit;

coupling the upper end of the frame assembly to the top drive and coupling the lower end of the frame assembly to the string of conduit; and lifting the string of conduit with the top drive, the weight of the string of conduit passing through the frame assembly and bypassing the blowout preventer and the packoff.

2. The method of claim 1 further comprising:

providing a spear with a tool latch and inserting the spear sealingly into the string of conduit;

lowering the wireline tool into the string of conduit; and pulling the wireline tool upward in the string of conduit and latching the wireline tool to the spear with the tool latch.

3. The method of claim 1 wherein the step of coupling the lower end of the frame assembly to the string of conduit comprises mounting a pipe elevator to the lower end of the frame assembly and engaging the string of conduit with the pipe elevator.

4. A wireline entry sub, comprising:

upper and lower flanges connected together by a frame;

a wireline blowout preventer mounted to the lower flange and extending upward therefrom within the frame;

a sheave mounted to the frame for guiding a wireline through the blowout preventer;

an upper tubular member secured to and extending upward from the upper flange for mounting to a top drive of a drilling rig; and a lower tubular member secured to and extending downward from the lower flange for engagement with a string of conduit so as to allow the top drive to lift the string of conduit, with the lifting force passing through the flanges and the frame and not through the blowout preventer.

5. The sub according to claim 4, wherein the frame comprises a plurality of connector rods.

6. The sub according to claim 4, further comprising a wireline packoff mounted to an upper end of the blowout prevent below the upper flange for sealing around the wireline.

7. The sub according to claim 4, further comprising:

a spear on a lower end of the lower tubular member, the spear adapted to be inserted into the string of conduit; and a latch mounted to the spear for latching to equipment retrieved by the wireline.

8. The sub according to claim 4, further comprising:

a pair of links pivotally mounted to the lower tubular member; and an elevator mounted to lower ends of the links for engaging and lifting the string of conduit.

* * * * *

UNITED STATES PATENT AND TRADEMARK OFFICE

CERTIFICATE OF CORRECTION

PATENT NO. : 7,575,061 B2
APPLICATION NO. : 11/458294
DATED : August 18, 2009
INVENTOR(S) : Angman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 130 days.

Signed and Sealed this

Seventh Day of September, 2010

David J. Kappos

David J. Kappos
*Director of the United States Patent and Trademark Office*